US010378093B2

(12) United States Patent
Chai

(10) Patent No.: US 10,378,093 B2
(45) Date of Patent: Aug. 13, 2019

(54) METHOD OF PRODUCING A NANO-TWINNED TITANIUM MATERIAL BY CASTING

(75) Inventor: Guocai Chai, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 626 days.

(21) Appl. No.: 13/996,243

(22) PCT Filed: Dec. 21, 2011

(86) PCT No.: PCT/EP2011/073598

§ 371 (c)(1), (2), (4) Date: Aug. 20, 2013

(87) PCT Pub. No.: WO2012/085089

PCT Pub. Date: Jun. 28, 2012

(65) Prior Publication Data

US 2015/0034216 A1 Feb. 5, 2015

(30) Foreign Application Priority Data

Dec. 22, 2010 (EP) ..... 10196576

(51) Int. Cl.
*C22F 1/18* (2006.01)
*C21D 6/04* (2006.01)

(52) U.S. Cl.
CPC ..... *C22F 1/183* (2013.01); *C21D 6/04* (2013.01); *C21D 2201/00* (2013.01)

(58) Field of Classification Search
CPC ..... C22F 1/183; C21D 6/04; C21D 2201/00
See application file for complete search history.

(56) References Cited

U.S. PATENT DOCUMENTS

2005/0109158 A1 5/2005 Keener
2007/0163681 A1* 7/2007 Gejima et al. ..... 148/421

OTHER PUBLICATIONS

Wang Y M et al: Abnormal strain hardening in nanostructured titanium at high strain rates and large strains:, Journal of Materials Science—Special Issue: Nanostructured Materials—Processing, Structures, Properties and Applications; Mar. 2007 (Mar. 2007), pp. 1751-1756,XP002639666, DOI: 10.1007/S10853-006-0822-0.

* cited by examiner

*Primary Examiner* — Colin W. Slifka
(74) *Attorney, Agent, or Firm* — Corinne R. Gorski

(57) ABSTRACT

A method of producing a nano twinned commercially pure titanium material includes the step of casting a commercially pure titanium material, that apart from titanium, contains not more than 0.05 wt % N; not more than 0.08 wt % C; not more than 0.015 wt % H; not more than 0.50 wt % Fe; not more than 0.40 wt % O; and not more than 0.40 wt % residuals. The material is brought to a temperature at or below 0° C. and plastic deformation is imparted to the material at that temperature to such a degree that nano twins are formed in the material.

19 Claims, 3 Drawing Sheets

METHOD OF PRODUCING A NANO-TWINNED TITANIUM MATERIAL BY CASTING

RELATED APPLICATION DATA

This application is a § 371 National Stage Application of PCT International Application No. PCT/EP2011/073598 filed on Dec. 21, 2011, claiming priority of EP Application No. 10196576.2, filed Dec. 22, 2010.

TECHNICAL FIELD

The invention relates to a method of producing a commercially pure titanium material containing nano twins.

BACKGROUND

Titanium has a number of applications where its advantageous mechanical properties and its relatively low specific weight are highly appreciated. In some applications it is interesting to use commercially pure titanium instead of the more commonly used alloys such as e.g. Ti-6Al-4V. This is especially interesting in applications where the final product may come in daily contact with human tissue, typically as implants, but also in other forms such as e.g. jewellery, piercings and the like.

This is due to the fact that vanadium, which often is present in Ti-6Al-4V and other mechanically advantageous alloys, is toxic and allergenic and is therefore not suited to be comprised in materials that are to be used as implants or in other similar applications. Further, the biocompatibility of commercially pure titanium is generally recognised as better than that of other titanium alloys.

A problem is however that titanium material with low vanadium content, such as e.g. commercially pure titanium, has markedly lower yield strength and tensile strength than the corresponding alloys.

There is therefore a need for a titanium material with low vanadium content, typically a commercially pure (CP) titanium material, with relatively higher yield and tensile strength than a conventional CP titanium material, and preferably with a conserved high ductility.

It is possible to increase the strength of a CP titanium material by introducing dislocations or by reducing the grain size. However, conventionally, these methods lead to an unwanted reduction of the ductility, which makes the material less suitable for most applications.

Lately, the introduction of nano twins in metal materials has proven to be an effective way to obtain materials with high strength and high ductility. All materials are however not susceptible to such processing. Further, there is no general operation, by means of which nano twins may be induced into a material. Different methods have been shown to have effects on the inducement of nano twins in different materials.

A twin may be defined as two separate crystals that share some of the same crystal lattice. For a nano twin the distance between the separate crystals is less than 1000 nm.

From the non-patent-literature document XP-002639666 it is known to strengthen nanostructured titanium at high strain rates. The titanium material is prepared by equal channel angular pressing plus cold rolling. Hence, the titanium material is an ultrafine-grained titanium material. During the deformation process of the titanium material at high strain rates twinning has been observed in the material.

Document US 2005/0109158 relates to a method of preparing ultrafine-grained titanium or titanium alloy articles. Coarse grained titanium materials are severely mechanically deformed using cryogenic milling into an ultrafine-grained powder. The method results in a material with improved mechanical properties.

There is however no known method of improving the strength of titanium that is not formed from powder, such as e.g. casted titanium.

SUMMARY

An object of the invention is to provide a commercially pure titanium material with improved strength, and a method of producing such a material. This is achieved by the invention according to the independent claims.

The invention relates to a method of producing a nano twinned commercially pure titanium material, which method comprises the steps of:

- casting a commercially pure titanium material that apart from titanium contains not more than 0.05 wt % N, not more than 0.08 wt % C, not more than 0.015 wt % H, not more than 0.50 wt % Fe, not more than 0.40 wt % O, and not more than 0.40 wt % residuals,
- bringing the material to a temperature at or below 0° C., and
- imparting plastic deformation to the material at that temperature to such a degree that nano twins are formed in the material.

Experiments show that by performing these steps nano twins are introduced into the material, wherein both the tensile strength and the yield strength of the titanium material increase. The invention is not limited to any specific type of casting, but is intended to cover all types of methods where the basic material is not a powder. Hence the invention covers, inter alia, continuous casting and mould casting. Further, the deformation at the low temperature may be performed at any time after the casting. In respect of the invention the casting step is important in order to obtain a microstructure that is susceptible to the remaining method steps of the invention. Hence, there is no limitation in that the deformation at low temperature should be made in conjunction to the casting step.

In an embodiment of the invention the deformation is imparted to the material at a rate of less than 2% per second, preferably less than 1.5% per second, and more preferably less than 1% per second.

A relatively low deformation rate is advantageous as is it keeps the temperature increase in the material at a controllable level. If the deformation rate is too high the temperature in the material may increase and negatively affect the predictability of the plastic deformation, such as the formation of nano twins.

Preferably the material is brought to a temperature below −50° C., or even more preferably −100° C., before the plastic deformation is imparted to the material.

In one embodiment of the inventive method the material is cooled to a temperature of −196° C., e.g. by means of liquid nitrogen, before the plastic deformation is imparted to the material.

In one embodiment of the inventive method the plastic deformation is imparted to the material by compression, from e.g. rolling.

As an alternative or complement to the compression, the plastic deformation may comprise straining, which is imparted to the material by e.g. drawing. The material may by plastically deformed to an extent that corresponds to a plastic deformation of at least 10%, preferably at least 20%, and more preferably at least 30%.

In a specific embodiment of the method according to the invention the plastic deformation is imparted to the material intermittently with less than 10% per deformation, preferably less than 6% per deformation, and more preferably less than 4% per deformation.

For the scope of this application the intermittent drawing implies that the drawing is performed in steps. Between each step the stress is momentarily lowered to below 90%, or preferably to below 80% or 70% of the momentarily stress for a short period of time, preferably more than 1 second, even more preferred more than 3 seconds, e.g. 5 to 10 seconds, before the drawing is resumed.

In a further embodiment of the method according to the invention the deformation is imparted to the material at a rate of more than 0.2% per second, preferably more than 0.4% per second and more preferably more than 0.6% per second.

In a further embodiment of the method according to the invention the casted commercially pure titanium material contains not more than 0.01 wt % H, and in another embodiment of the method according to the invention the material contains not more than 0.45 wt % Fe. In yet a further embodiment the casted commercially pure titanium material does not contain more than 0.35 wt % O and preferably not more than 0.30 wt % O.

With the inventive method a commercially pure titanium material with a comparatively high strength is produced. The mean nano-scale twin spacing in the material provided by the method is below 1000 nm.

Preferably the material has a nano-scale twin spacing below 500 nm, and more preferably below 300 nm.

Due to the method of the invention the material will preferably obtain a yield strength of above 700 MPa, preferably above 750 MPa, and more preferably above 800 MPa.

In another preferable embodiment of the invention the material has a tensile strength of above 750 MPa, preferably above 800 MPa, and more preferably above 850 MPa.

SHORT DESCRIPTION OF THE DRAWINGS

Below the invention will be described in detail with reference to the accompanying figures, of which:

DETAILED DESCRIPTION

Figure 1:
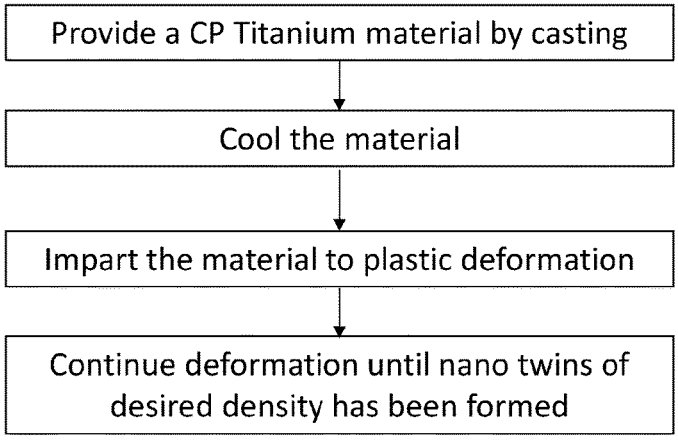
FIG. 1 shows a logic flow diagram illustrating the method according to the invention.

The present invention provides an improvement for commercially pure titanium materials and specifically to a method of producing such materials.

Titanium exists in a number of grades of varying composition. Titanium of composition that corresponds to either of the grades 1 to 4 is generally denoted as commercially pure. Titanium with a composition of grade 5 is generally known as Ti-6Al-4V and is today the most widely used titanium material due to its very good mechanical properties.

The composition of the titanium materials of grades 1-5 are presented below in table 1. Values indicate maximum wt % unless an interval is given.

TABLE 1

Composition of different grades of titanium. (wt %)

| | O | N | C | H | Fe | Al | V | Residuals |
|---|---|---|---|---|---|---|---|---|
| Grade 1 | 0.18 | 0.03 | 0.08 | 0.015 | 0.2 | | | 0.4 |
| Grade 2 | 0.25 | 0.03 | 0.08 | 0.015 | 0.3 | | | 0.4 |
| Grade 3 | 0.35 | 0.05 | 0.08 | 0.015 | 0.30 | | | 0.4 |
| Grade 4 | 0.40 | 0.05 | 0.08 | 0.015 | 0.50 | | | 0.4 |
| Grade 5 | 0.20 | 0.05 | 0.08 | 0.015 | 0.40 | 5.5-6.75 | 3.5-4.5 | 0.4 |

As indicated above the commercially pure titanium materials are very attractive in some application such as e.g. in the medical field, because they contain no or only very small amounts of the allergenic metal vanadium. A specific object of the invention is to find a method of improving the mechanical properties, especially the yield strength, of a titanium material of a composition within grades 1-4 such that they correspond to the mechanical properties a titanium material of a composition within grade 5.

Generally, for the commercially pure titanium materials the strength of the material will increase proportionally to an increased oxygen content. In table 2 some typical mechanical properties of titanium grades 1-5 and grade 23 are shown, where Rp0.2 corresponds to the Yield strength at a plastic deformation of 0.2%, Rm corresponds to the tensile strength, A corresponds to the elongation (ultimate strain) and E corresponds to Young's modulus.

TABLE 2

Typical mechanical properties of different grades of titanium.

| | Rp0.2 (MPa) | Rm (MPa) | A (%) | E (GPa) |
|---|---|---|---|---|
| Ti Grade 1 | 170 | 240 | 24 | 102.7 |
| Ti Grade 2 | 275 | 345 | 20 | 102.7 |
| Ti Grade 3 | 380 | 450 | 18 | 103.4 |
| Ti Grade 4 | 483 | 550 | 15 | 104.1 |
| Ti Grade 5 | 828 | 895 | 10 | 110-114 |
| Ti Grade 23 | 775 | 948 | 16.4 | |

In accordance with the invention it has been shown that nano-twins may be introduced in commercially pure titanium material. This will be shown below in four examples from which an inventive generalisation is possible.

The compositions of the four exemplary samples are shown in table 3.

TABLE 3

Composition of the four exemplary samples. (max wt %)

| Composition | N | C | H | Fe | O | Al | Others |
|---|---|---|---|---|---|---|---|
| CP Ti #1 | 0.03 | 0.06 | 0.01 | 0.1 | 0.19 | — | — |
| CP Ti #2, #3 | 0.05 | 0.06 | 0.01 | 0.2 | 0.225 | — | — |
| CP Ti #4 | 0.01 | 0.01 | 0.01 | 0.4 | 0.28 | — | — |

From table 3 it can be concluded that the first sample, i.e. CP Ti #1, has a composition that belongs to titanium grade 2, and that the second and third samples, i.e. CP Ti #2 and

#3, have a composition that belongs to titanium grade 3, due the higher content of Nitrogen. The fourth sample belongs to grade 4 due the higher content of Iron.

In the 4 examples below the samples were subjected to intermittent drawing. For the scope of this application the stepwise or intermittent drawing implies that the stress is momentarily lowered to below 90%, or preferably to below 80% or 70% of the momentarily stress for a short period of time, e.g. 5 to 10 seconds, before the drawing is resumed.

The intermittent plastic deformation has proven to be an effective way of increasing the total tolerance to deformation, such that a higher total deformation may be achieved than for a continuous deformation.

Further in order to avoid a temperature increase during the drawing, the material was continuously cooled throughout the whole drawing process.

The start material for the examples below is a bar material that is produced in a conventional metallurgical method including melting, casting, forging/hot rolling and extrusion into the bar material.

Hence, the inventive method may be performed on an otherwise finalised product.

Example 1

In the first example, the sample CP Ti #1 was cooled to a temperature below −100° C. and was subsequently plastically deformed at this temperature.

The sample, which had an initial total length of 50 mm, was plastically deformed by tension at a rate of 20 mm/min (0.67% per second) to a total deformation of 35%. The deformation was made in intervals of 2% at a time.

Example 2

In the second example, the sample CP Ti #2 was cooled to a temperature below −100° C. and was subsequently plastically deformed at this temperature.

The sample, which had an initial total length of 50 mm, was plastically deformed by tension at a rate of 30 mm/min (1% per second) to a total deformation of 35%. The deformation was made in intervals of 2% at a time.

Example 3

In the third example, the sample CP Ti #3 was cooled to a temperature below −100° C. and was subsequently plastically deformed at this temperature.

The sample, which had an initial total length of 50 mm, was plastically deformed by tension at a rate of 20 mm/min (0.67% per second) to a total deformation of 40%. The deformation was made in intervals of 2% at a time.

Example 4

In the fourth example, the sample CP Ti #4 was cooled to a temperature below −100° C. and was subsequently plastically deformed at this temperature.

The sample, which had an initial total length of 50 mm, was plastically deformed by tension at a rate of 30 mm/min (1% per second) to a total deformation of 25%. The deformation was made in intervals of 2% at a time.

After concluded pretension at the indicated temperatures the samples #1-4 were left in room temperature for subsequent testing of mechanical properties in room temperature.

The observed mechanical properties of the samples are represented in table 4.

From table 4 it is apparent that both the yield strength and the tensile strength have increased markedly for all four samples with respect to the corresponding reference values for titanium materials of grade 2 and 3. This increase of the strengths is due to the formation of nano twins in the structure of the materials, which are induced by the pre-straining at low temperature, such that they correspond to or even exceed the properties of the reference materials, e.g. titanium grade 5 and grade 23.

TABLE 4

Mechanical properties of the samples in comparison to references.

| | Rp0.2 (MPa) | Rm (MPa) | A (%) | $\varepsilon_f$ (%) | Z (%) | E (GPa) |
|---|---|---|---|---|---|---|
| nano twinned CP Ti #1 | 813 | 829 | 19.4 | 13-15 | 55 | 120 |
| nano twinned CP Ti #2 | 803 | 818 | 19 | 12-14 | 56 | 116 |
| nano twinned CP Ti #3 | 912 | 1170 | | | 52 | |
| nano twinned CP Ti #4 | 747 | 829 | 12.5 | | | 107 |
| Ti-6Al-4V (Ti Grade 5) | 828 | 895 | 10 | 6-7 | | 110-114 |
| Ti Grade 23 | 775 | 948 | 16.4 | | 57 | |

From the examples represented above an inventive method may be generalised. In the following part of this detailed description a logic flow diagram of a method of producing commercially pure titanium material according to the invention is described, with reference to FIG. 1.

In a first step a commercially pure titanium material is provided. In accordance with the invention the provided material is casted and is not produced by a powder method, such as e.g. sintering and/or hot isostatic pressing (HIP).

The casted titanium material is cooled to a temperature below room temperature. As a general rule, the lower the temperature, the bigger the effect of the nano twins will be.

Figure 2:
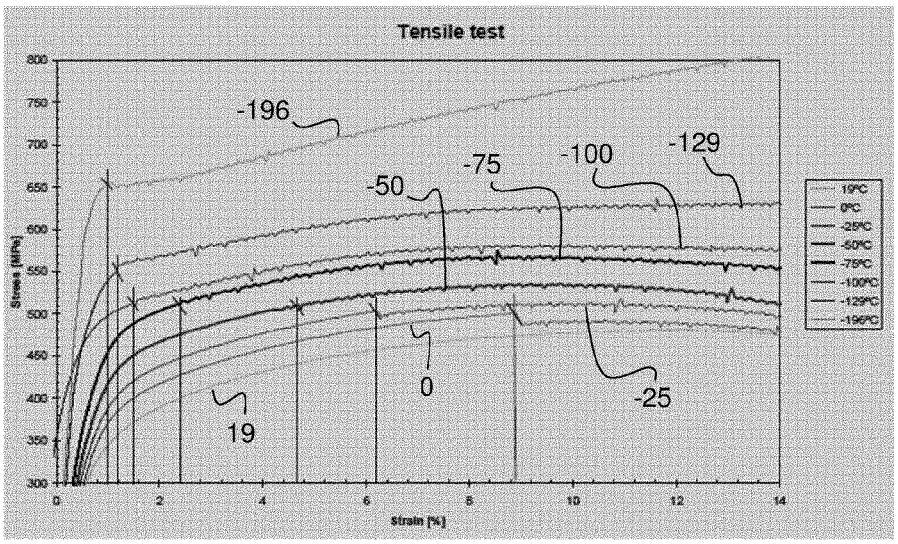
FIG. 2 shows a diagram illustrating the tensile stress to strain for a CP titanium material at different temperatures.

In FIG. 2, a diagram is shown over a tensile test of a titanium grade 2 material. In this diagram a sudden drop of the stress followed by portion of serrated curves may be observed. These serrated curves indicate that twinning has occurred. Further, the diagram in FIG. 2 reveals that the temperature at which the tensile tests are performed has a strong influence on the strength of the material, but also on the strain at which the sudden drop of the stress occurs. The lower the temperature the less strain is needed to provoke the sudden drop of the stress and thus to start the formation of twins.

From the diagram it is also apparent that twins may be formed from a temperature of 0° C. and below, although the formation of twins does only occur above a strain of about 9% at 0° C.

In step 4 of the logic flow diagram the material is imparted to a plastic deformation until a nano twinning occur in the material. The plastic deformation should be upheld until a nano twinning of a certain density or "nano scale twin spacing" is achieved in the material. This is described more closely below.

In view of the shown examples, there is a wide composition span in which a nano twinned material with satisfactory mechanical properties may be obtained by means of the plastic deformation at low temperature. Specifically it appears that the oxygen content, which governs the strength of CP titanium material without nano twins, does not have to be high in order for nano twins to be formed. In sample CP Ti #1 the oxygen content is as low as 0.19 wt %, which is borderline to the definition of titanium grade 1 (not more than 0.18%).

In order to verify the theory that the samples CP Ti #1-4 actually contain nano twins, their respective microstructure was studied both in a low magnification microscope and in a TEM study.

Figure 3:
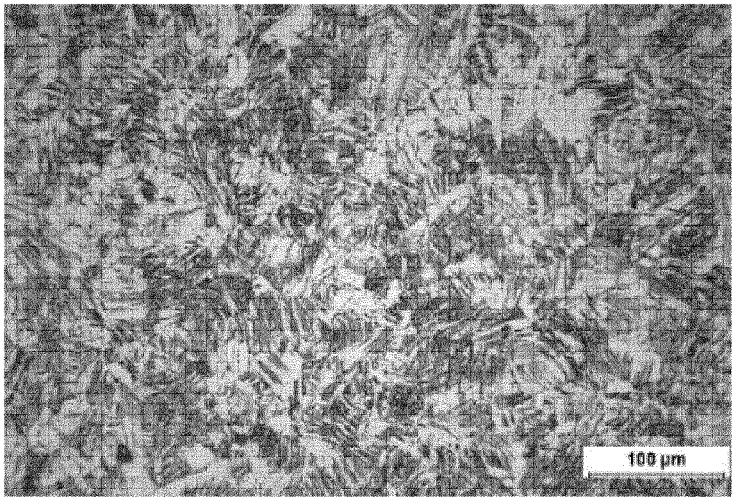
FIG. 3 shows a microscope view of a nano twinned CP Ti-material produced in accordance with the invention.

Nano-twinned pure titanium materials have a microstructure full of needles or lath-shaped patterns. These needles or lathes are shown at a relatively low magnification in FIG. 3. As is visible the needles or lathes have similar crystal orientations within a specific cluster, but each cluster has a specific orientation, which is independent of the neighbouring clusters.

Figure 4:
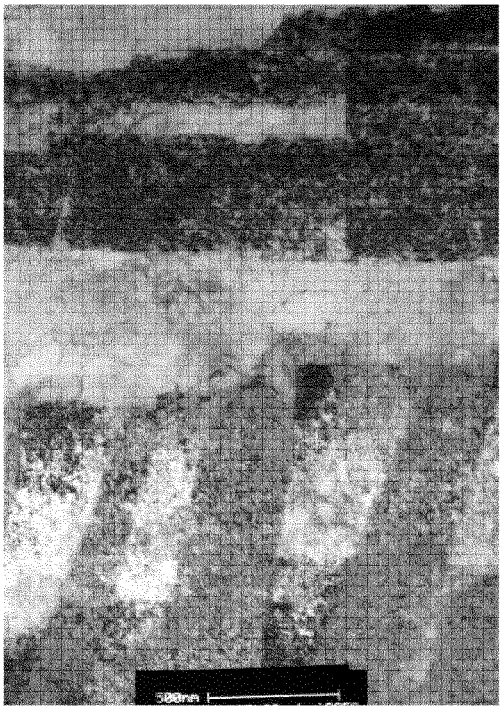
FIG. 4 shows a TEM-study of a nano twinned CP Ti-material produced in accordance with the invention.

The density of the nano-twins can be very high, as is visible in the TEM study in FIG. 4. In this case it is higher than 72%. The so-called "nano-scale twin spacing" for the material is below 1000 nm. For most of the twins the nano-scale twin spacing is below 500 nm, and especially below 300 nm. Further, most of the twins have a "nano-scale twin spacing" above 50 nm.

Figure 5:
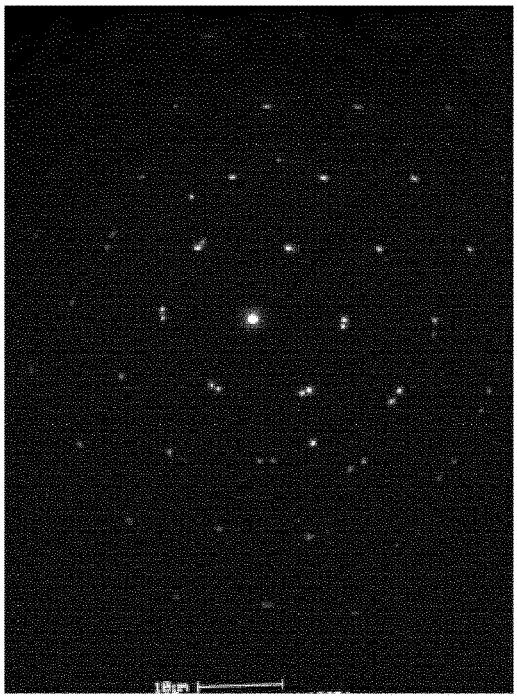
FIG. 5 shows an X-ray diffraction pattern of a nano twinned CP Ti-material produced in accordance with the invention.

The twin domains do not extend throughout a whole grain, but are rather divided into shorter segments. The misorientations between the grains are large, with entirely different crystallographic orientations of neighbouring domains. From the X-ray diffraction pattern shown in FIG. 5 small complementary dots appear close to most dots that constitute the characteristic HCP-structure of the titanium. These complementary dots indicate the presence of twins.

Figure 6:
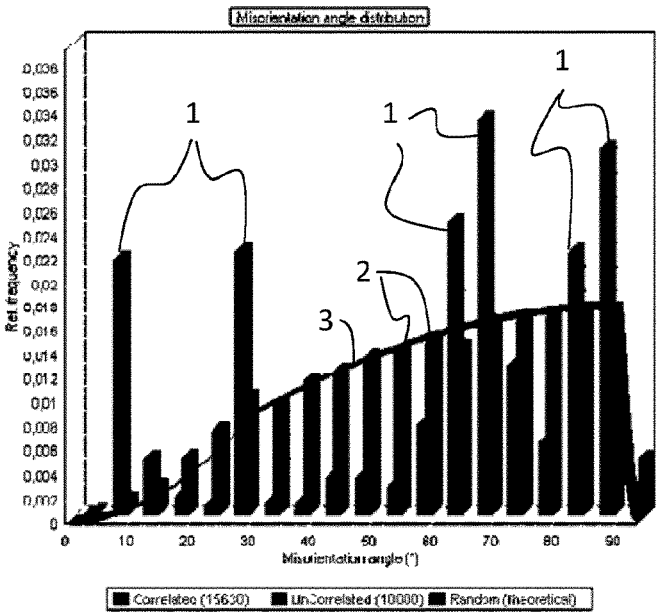
FIG. 6 shows a measurement of misorientation mapping in a nano twinned material produced in accordance with the invention.

FIG. 6 shows a measurement of a misorientation mapping in the nano twinned CP titanium material. In this figure, the uncorrelated peaks are denoted with reference numeral 1, wherein the correlated peaks are denoted with reference numeral 2. The correlated peaks 2 follow the random or theoretical line, which is denoted with reference numeral 3. There are several uncorrelated peaks at about 9, 29, 63 and 69, 83 and 89. These misorientations are different from those of normal CP titanium material, where there are only two misorientations located at 60 and 85. The misorientation at 60 is formed by compressive twinning, and the misorientation at 85 is formed by tensile twinning. The misorientation at 32 is usually formed by 27 twinning. The misorientations that are smaller than 10 to 20 are formed by special low angle grain boundaries, which do not represent twins.

One speculation that can be made concerning the nano twinned materials is that the misorientations at 63 and 69 can belong to one group (compressive twinning) and the misorientations at 83 and 89 can belong to another group (tensile twinning).

From the TEM-study it may however be concluded that twins are present, and that most of the twin domains are of such a size, at least smaller than 1000 nm, that they should be referred to as nano twins.

In this description four examples are represented. Other examples of similar characteristics have however also been performed that support the represented examples and the achieved mechanical properties. The invention is thus not limited by the represented examples, but by the following claims.

The invention claimed is:

1. A method of producing a nano twinned commercially pure titanium material, comprising the steps of:

casting a commercially pure titanium material that apart from titanium contains not more than 0.05 wt % N, not more than 0.08 wt % C, not more than 0.015 wt % H, not more than 0.50 wt % Fe, not more than 0.40 wt % O, and not more than 0.40 wt % residuals;

bringing the casted material to a temperature at or below 0° C.; and subsequently imparting plastic deformation to the material at the temperature and a rate of less than 2% per second such that nano twins are formed in the material, the material having a yield strength of above 700 MPa and a tensile strength strength of above 750 MPa.

2. The method according to claim 1, wherein the deformation is imparted to the material at a rate of less than 1.5% per second.

3. The method according to claim 1, wherein the deformation is imparted to the material at a rate of less than 1% per second.

4. The method according to claim 1, wherein the material is brought to a temperature below −50° C. and that the plastic deformation is imparted to the material at that temperature.

5. The method according to claim 1, wherein the material is brought to a temperature below −100° C. and that the plastic deformation is imparted to the material at that temperature.

6. The method according to claim 1, wherein the material is cooled to a temperature of −196° C. and that the plastic deformation is imparted to the material at that temperature.

7. The method according to claim 1, wherein the plastic deformation is imparted to the material by compression.

8. The method according to claim 1, wherein the plastic deformation comprises straining imparted to the material by drawing.

9. The method according to claim 1, wherein the material is plastically deformed to an extent that corresponds to a plastic deformation of at least 10%.

10. The method according to claim 9, wherein the plastic deformation is imparted to the material intermittently with less than 10% per deformation.

11. The method according to claim 9, wherein the plastic deformation is imparted to the material intermittently with less than 6% per deformation.

12. The method according to claim 9, wherein the plastic deformation is imparted to the material intermittently with less than 4% per deformation.

13. The method according claim 1, wherein the deformation is imparted to the material at a rate of more than 0.2% per second.

14. The method according to claim 13, wherein the deformation is imparted to the material at a rate of more than 0.4% per second.

15. The method according to claim 13, wherein the deformation is imparted to the material at a rate of more than 0.6% per second.

16. The method according to claim 1, wherein the casted commercially pure titanium material does not contain more than 0.35 wt % O.

17. The method according to claim 1, wherein the material is plastically deformed to an extent that corresponds to a plastic deformation of at least 20%.

18. The method according to claim 1, wherein the material is plastically deformed to an extent that corresponds to a plastic deformation of at least 30%.

19. The method according to claim 1, wherein the casted commercially pure titanium material does not contain more than 0.30 wt % O.

* * * * *